US005441387A

United States Patent [19]

Yu

[11] Patent Number: 5,441,387

[45] Date of Patent: Aug. 15, 1995

[54] HOUSING COMBINATION FOR CEILING FAN

[76] Inventor: Jack Yu, No. 109-1, Avenue 6, Lane 164, Tzong Sa Road, Da Du Hsiang, Taichung Hsien, Taiwan

[21] Appl. No.: 329,639

[22] Filed: Oct. 26, 1994

[51] Int. Cl.[6] ..... F04D 29/00

[52] U.S. Cl. ..... 416/5; 416/93 R; 417/423.14; 310/89

[58] Field of Search ..... 416/5, 93 R, 170 R; D23/377, 379, 385, 411; 417/423.14; 310/89; 362/147, 363, 367

[56] References Cited

U.S. PATENT DOCUMENTS 4,356,540 10/1982 Goralnik ..... 362/147
4,382,400 5/1983 Stutzman ..... 416/5
4,518,314 5/1985 Schultz ..... 416/93 R
4,626,970 12/1986 Huang ..... 416/5
4,863,346 9/1989 Lin ..... 416/5

OTHER PUBLICATIONS

Beverlyills Fan Company brochure, Dec. 1992, 5 pages.

*Primary Examiner*—Edward K. Look
*Assistant Examiner*—James A. Larson
*Attorney, Agent, or Firm*—Morton J. Rosenberg; David I. Klein

[57] ABSTRACT

A housing for act ceiling fan includes a cylindrical member and a bottom plate each having a number of openings for engaging with a number of frames. The frames each includes an inner peripheral channel for engaging with a number of panels. The panels can be easily formed with various kinds of colors and patterns for decoration purposes, and can be easily changed for changing different patterns.

1 Claim, 3 Drawing Sheets

HOUSING COMBINATION FOR CEILING FAN

BACKGROUND OF THE INVENTION

1. Field of the Invention

The present invention relates to a housing combination, and more particularly to a housing combination for ceiling fans.

2. Description of the Prior Art

Typical ceiling fan housings comprising a lower cap, an upper cap and a cylindrical member clamped between the lower cap and the upper cap for housing the motor of the ceiling fan. The cylindrical member is normally made of glass materials and is normally formed, by molding processes, with three-dimensional or spatial patterns thereon for decorative purposes. However, the spatial patterns can not be easily changed due to the expensive and definitive molds. In addition, the cylindrical members are made of glass material such that the color of the spatial patterns also can not be easily changed and such that the cylindrical members include a weak configuration that will be easily broken.

The present invention has arisen to mitigate and/or obviate the afore-described disadvantages of the conventional ceiling fan housings.

SUMMARY OF THE INVENTION

The primary objective of the present invention is to provide a housing combination for a ceiling fan which includes a configuration that has excellent strength.

The other objective of the present invention is to provide a housing combination for a ceiling fan in which no spatial patterns are required to be formed on the cylindrical member and the decorative patterns can be easily changed.

In accordance with one aspect of the invention, there is provided a housing combination for a ceiling fan comprising a body including a cylindrical member and a bottom plate having an orifice formed therein, the cylindrical member and the bottom plate each including a plurality of openings formed therein, a plurality of frames engaged in the openings respectively and secured to the body, the frames each including an inner peripheral portion having channel means formed therein, and a plurality of panels engaged in the channel means of the frames so as to be secured to the body.

Further objectives and advantages of the present invention will become apparent from a careful reading of a detailed description provided hereinbelow, with appropriate reference to accompanying drawings.

DETAILED DESCRIPTION 0F THE PREFERRED EMBODIMENT

Figure 1:
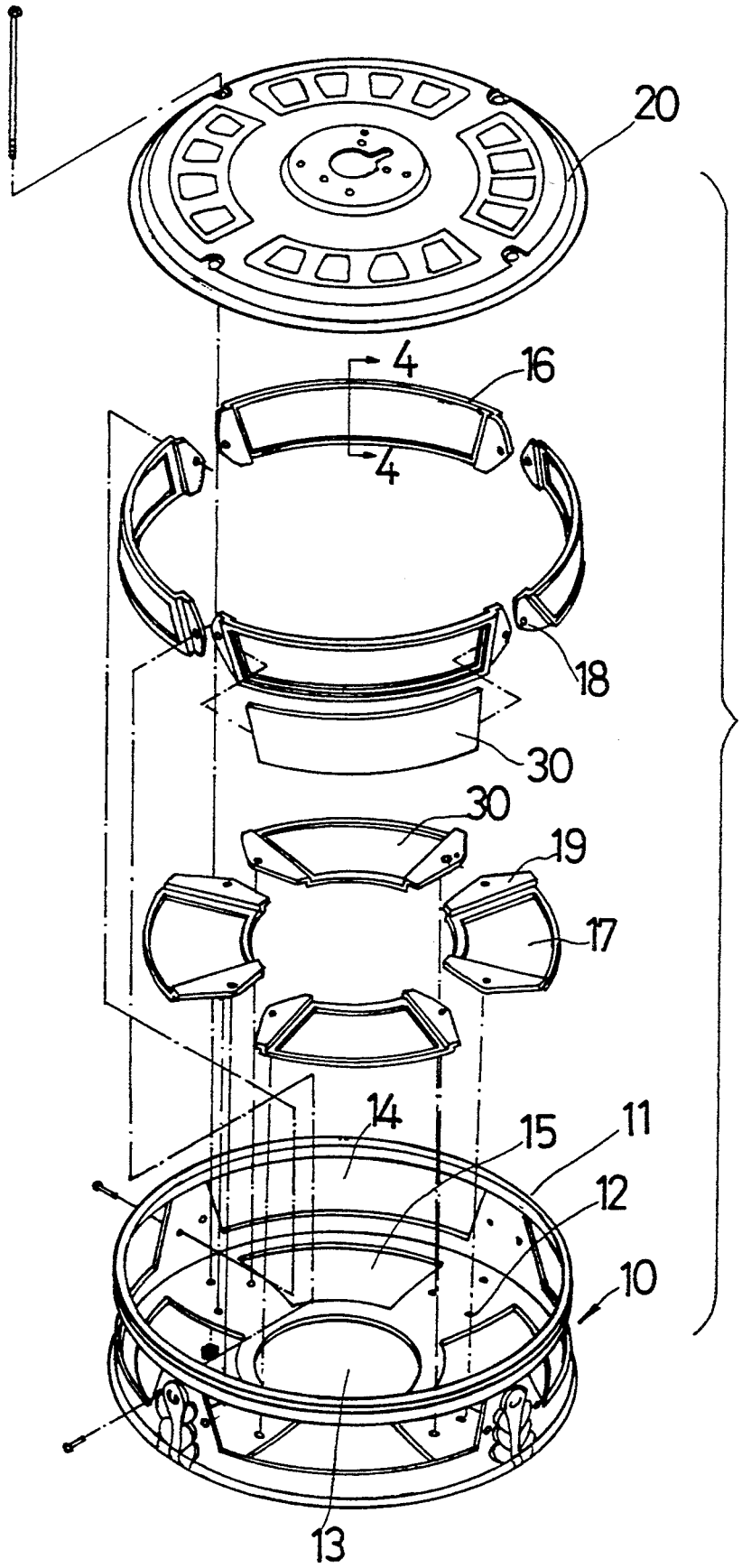
FIG. 1 is an exploded view of a housing combination for a ceiling fan in accordance with the present invention.
Figure 2:
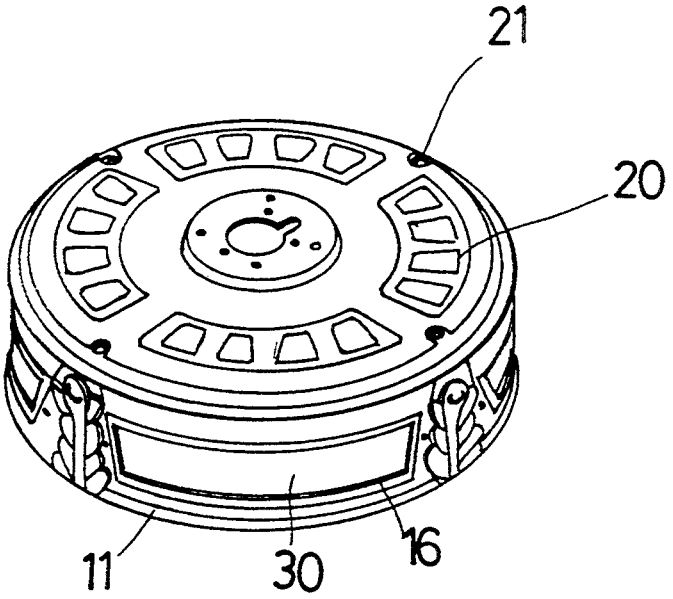
FIG. 2 is an upper perspective view of the ceiling fan housing combination.
Figure 3:
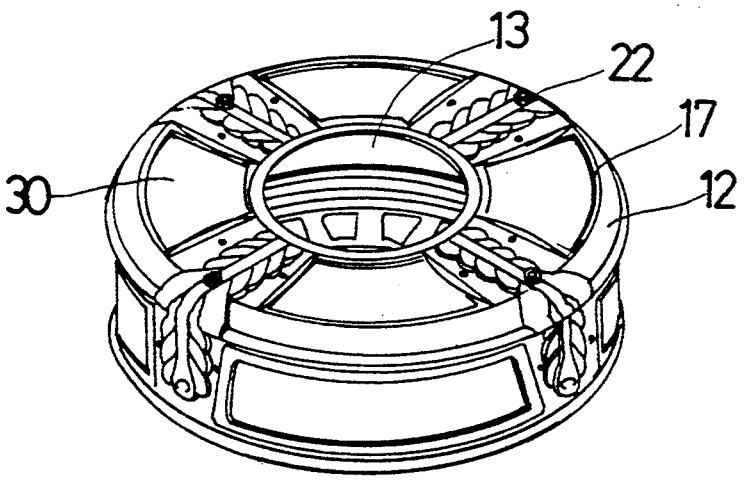
FIG. 3 is a bottom perspective view of the ceiling fan housing combination.

Referring to the drawings, and initially to FIGS. 1 to 3, a housing combination in accordance with the present invention is provided for receiving the motor of ceiling fans and comprises a body 10 including a cylindrical member 11 and a bottom plate 12. The bottom plate 12 includes an orifice 13 formed in the center portion for insertion of a control box of the ceiling fan. A cap 20 is engaged on the body 10 so as to form the housing combination of the ceiling fan. The cylindrical member 11 and the bottom plate 12 each includes a number of openings 14, 15 formed therein for engaging with a number of frames 16, 17. The frames 16, 17 each includes two side portions having ears 18, 19 extended therefrom for securing to the body 10.

Figure 4:
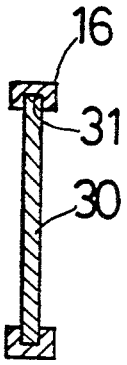
FIG. 4 is a cross sectional view taken along lines 4—4 of FIG. 1.

Referring next to FIG. 4, and again to FIG. 1, a number of panels 30 are engaged in the frames 16, 17 which are preferably made of soft materials such as rubber, plastic or foamable materials. The frames 16, 17 each includes an inner peripheral channel 31 for engaging with the panels 30. The panels 30 are preferably made of transparent materials having various kinds of colors and patterns applied thereto for decoration purposes.

It is to be noted that the body 10 includes a solid configuration having excellent strength, and the panels 30 include a small size that can be easily manufactured and that will not be easily broken as compared with typical cylindrical member of glass materials. The panels 30 may be easily formed with various kinds of patterns and colors thereon, and can be easily replaced for changing different patterns.

Figure 5:
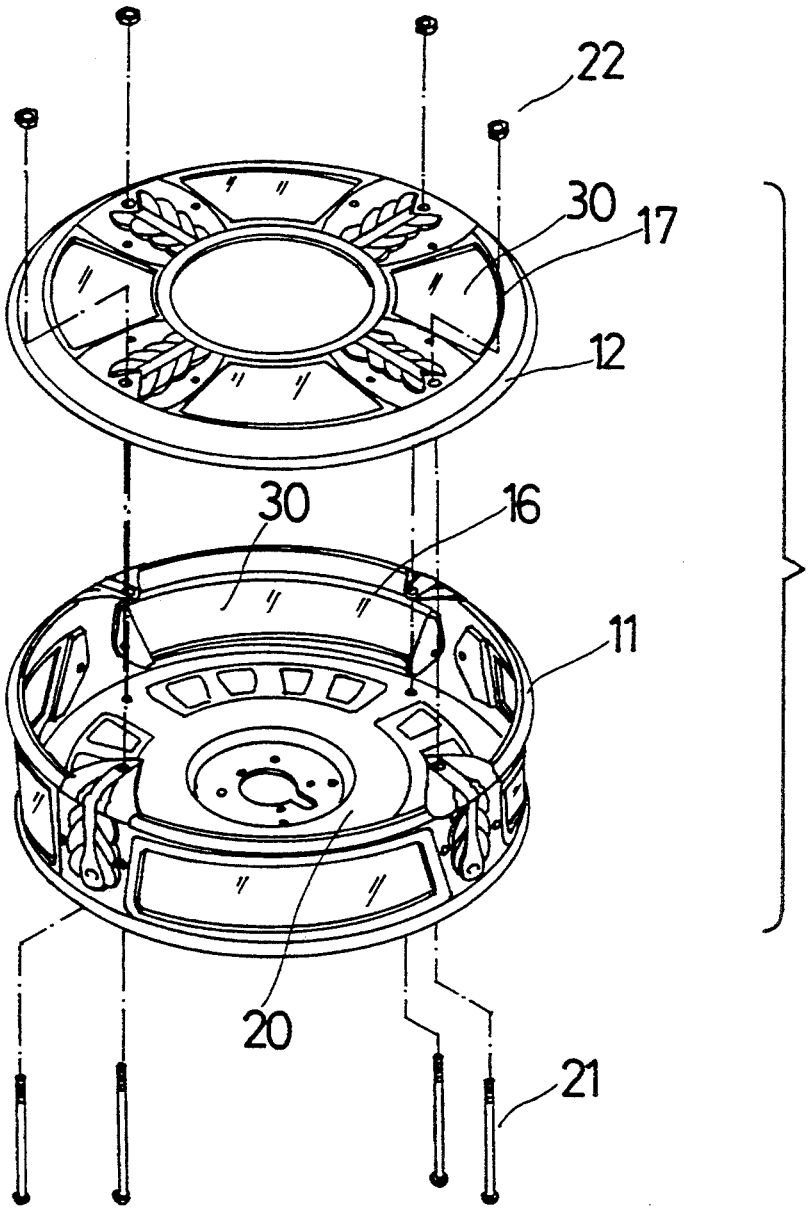
FIG. 5 is a bottom partial exploded view of the housing combination.

Referring next to FIG. 5, illustrated is a partial exploded view as seen from the bottom of the housing. The bottom plate 12 may be separated from the cylindrical member 11 instead of being secured to the cylindrical member 11. The cylindrical member 11 and the bottom plate 12 can be easily manufactured separately.

Accordingly, the ceiling fan housing combination in accordance with the present invention includes a body that includes excellent strength and includes a number of panels that can be easily formed with different patterns and can be easily changed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A housing combination for a ceiling fan comprising:

a body including a cylindrical member and a bottom plate having an orifice formed therein, said cylindrical member and said bottom plate each including a plurality of openings formed therein, a plurality of frames engaged in said openings respectively and secured to said body, said frames each including an inner peripheral portion having channel means formed therein, and a plurality of panels engaged in said channel means of said frames so as to be secured to said body.

* * * * *